US007082281B2

(12) United States Patent
Jung et al.

(10) Patent No.: US 7,082,281 B2
(45) Date of Patent: Jul. 25, 2006

(54) ELECTROPHOTOGRAPHIC PRINTER HAVING MOVABLE PRE-TRANSFER ERASING UNIT

(75) Inventors: Woo-chul Jung, Yongin-si (KR); Heung-sup Jeong, Suwon-si (KR); Byeong-hwa Ahn, Seongnam-si (KR); Se-hyun Lyu, Seoul (KR); Young-min Yoon, Yongin-si (KR); Jae-myoung Choi, Suwon-si (KR); Jin-soo Lee, Suwon-si (KR); Heung-kyu Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/821,994

(22) Filed: Apr. 12, 2004

(65) Prior Publication Data

US 2005/0002691 A1 Jan. 6, 2005

(30) Foreign Application Priority Data

Jul. 4, 2003 (KR) ..... 10-2003-0045394

(51) Int. Cl.
*G03G 15/16* (2006.01)

(52) U.S. Cl. ..... 399/296

(58) Field of Classification Search ..... 399/128
See application file for complete search history.

(56) References Cited

U.S. PATENT DOCUMENTS 4,615,605 A * 10/1986 Kida et al. ..... 399/113
4,864,364 A * 9/1989 Ogino et al. ..... 399/4
6,356,726 B1 * 3/2002 Campbell et al. ..... 399/128
6,763,213 B1 * 7/2004 Ahn ..... 399/228

* cited by examiner

*Primary Examiner*—Quana Grainger
(74) *Attorney, Agent, or Firm*—Stanzione & Kim LLP

(57) ABSTRACT

An electrophotographic printer including a pre-erasing unit. The pre-erasing unit includes a pre-erasing lamp to irradiate light, and a pre-transfer erasing lens to induce the light generated from the pre-transfer erasing lamp to the photosensitive drum, movably installed such that it moves to an erasure position at which the pre-transfer erasing lens is close to the photosensitive drum for erasure, and moves to a retracted position spaced apart from the photosensitive drum so as not to interfere therewith when the photosensitive drum unit is being mounted or dismounted. The pre-erasing unit may further include an elastic member to provide elasticity in a direction in which the pre-transfer erasing lens moves to the retracted position.

17 Claims, 6 Drawing Sheets

ELECTROPHOTOGRAPHIC PRINTER HAVING MOVABLE PRE-TRANSFER ERASING UNIT

CROSS-REFERENCE TO RELATED APPLICATIONS

This application claims the priority of Korean Patent Application No. 2003-45394, filed on Jul. 4, 2003, in the Korean Intellectual Property Office, the disclosure of which is incorporated herein in its entirety by reference.

BACKGROUND OF THE INVENTION

1. Field of the Invention

The present invention relates to an electrophotographic printer, and more particularly, to an electrophotographic printer based on multi-pass printing.

2. Description of the Related Art

In general, electrophotographic printers form an electrostatic latent image by radiating light on a photosensitive medium charged to a predetermined potential, develop the electrostatic latent image using a toner having a predetermined color image to form a toner image, transfer the toner image onto a recording medium, and fuse the toner image on the recording medium, thereby printing a monochromic or a multi-color image.

Electrophotographic printers are typically classified into wet type electrophotographic printers and dry type electrophotographic printers according to a developer used. A wet type electrophotographic printer uses a developer having powdered toner dispersed in a liquid carrier. A dry type electrophotographic printer uses a two-component developer having a powdered carrier mixed with a toner, or a one-component developer without the carrier. The dry type electrophotographic printer will now be described, and the term "developer" used throughout the specification indicates a toner for the convenience sake.

Printing of a color image generally requires yellow (Y), magenta (M), cyan (C) and black (K) toners. Accordingly, four development units for developing the respective color toners are needed. Either a single-pass printing which requires four exposure units and a photosensitive medium, or a multi-pass printing which requires a single exposure unit and a photosensitive medium, may be employed in printing a color image. In either case, four development units are necessary.

A single-pass printing process allows both monochromic image printing and color image printing to be performed faster than a multi-pass printing process because printing is performed in a single pass in both cases. On the other hand, although a multi-pass printing process requires a printing time of four or more times longer in color image printing than in monochromic image printing, it can be implemented by a simplified structure.

SUMMARY OF THE INVENTION

The present invention provides a dry type electrophotographic printer based on multi-pass printing, configured to be capable of preventing a photosensitive medium from being damaged due to interference between the photosensitive medium and a pre-transfer eraser in mounting or dismounting disposables such as a photosensitive medium, a developing device or a transfer medium.

Additional aspects and advantages of the invention will be set forth in part in the description which follows and, in part, will be obvious from the description, or may be learned by practice of the invention.

According to one aspect of the present invention, there is provided an electrophotographic printer including a photosensitive drum on which an electrostatic latent image is formed, at least one development unit having a developing roller to form a toner image by supplying toner to the electrostatic latent image, and a pre-transfer eraser to remove charges from a non-image region of the photosensitive drum by irradiating light onto the photosensitive drum after the toner image is developed, wherein the pre-erasing unit includes a pre-erasing lamp of irradiating light, and a pre-transfer erasing lens to induce the light generated from the pre-transfer erasing lamp to the photosensitive drum, movably installed such that it moves to an erasure position at which the pre-transfer erasing lens is close to the photosensitive drum to perform erasure, and to a retracted position spaced apart from the photosensitive drum so as not to interfere therewith when the photosensitive drum unit is mounted or dismounted.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
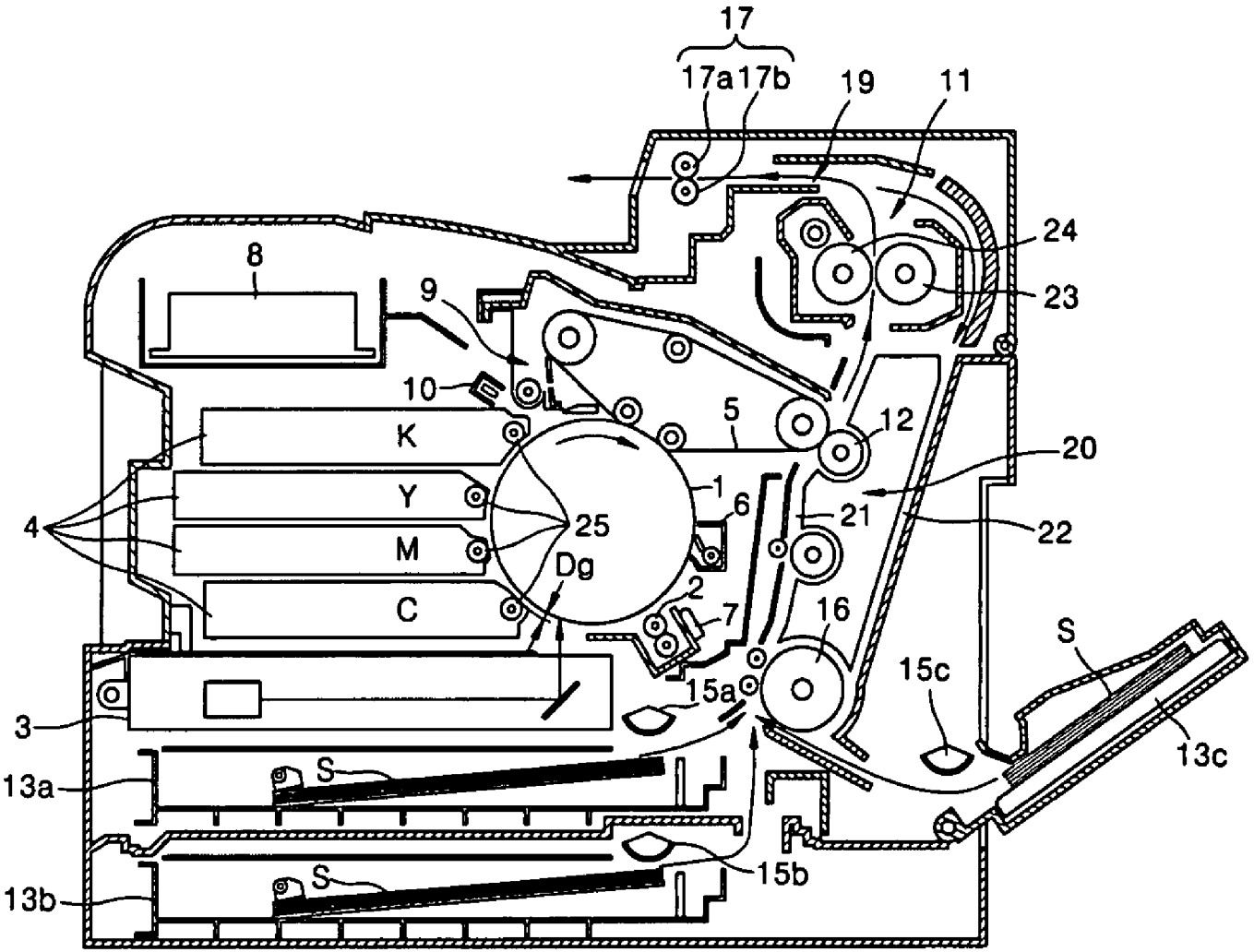
FIG. 1 is a schematic diagram of an electrophotographic printer according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 is a schematic diagram of an electrophotographic printer according to an embodiment of the present invention.

Referring to FIG. 1, the electrophotographic printer according to this embodiment includes a photosensitive drum 1, a charge roller 2, an exposing unit 3, four development units 4, and a transfer belt 5.

The photosensitive drum 1 can be a cylindrical metal drum having a photoconductive layer formed on its outer circumferential surface.

The charge roller 2 is a charger that can uniformly charge the photosensitive drum 1. The charge roller 2 supplies charges to the photosensitive drum 1 while rotating in a contact or non-contact manner with respect to the outer circumferential surface of the photosensitive drum 1, thereby making the outer circumferential surface of the photosensitive drum 1 have a uniform potential. A corona discharger (not shown) can be used as the charger as an alternative of the charge roller 2.

The exposing unit 3 can be disposed below the photosensitive drum 1, and irradiates light corresponding to an image's information onto the uniformly charged photosensitive drum 1, thereby forming an electrostatic latent image on the photosensitive drum 1. A laser scanning unit (LSU) using a laser diode as a light source, is generally used as the exposing unit 3.

Four development units 4C, 4M, 4Y and 4K contain solid powdered toners of cyan (C), magenta (M), yellow (Y) and black (K), respectively, and each of the development units 4C, 4M, 4Y and 4K includes a developing roller 25 to supply each respective toner to the electrostatic latent image formed on the photosensitive drum 1 and form a toner image. The four development units 4C, 4M, 4Y and 4K may be configured such that the developing roller 25 is spaced apart from the outer circumferential surface of the photosensitive drum 1 by a developing gap Dg. The developing gap Dg can be preferably several tens to several hundreds of microns.

Cyan (C), magenta (M), yellow (Y) and black (K) toner images sequentially formed on the photosensitive drum 1 are in turn transferred to the transfer belt 5 and overlap, thereby forming a multi-color toner image. A linear traveling speed of the transfer belt 5 can be the same as a linear rotating speed of the photosensitive drum 1. A length of the transfer belt 5 should be the same or longer than a length of a sheet of paper (S) (or other recording medium) on which a multi-color toner image is finally formed.

Reference numeral 12 denotes a transfer roller. The transfer roller 12 is opposite to and faces the transfer belt 5. While the multi-color toner image is being transferred to the transfer belt 5, the transfer roller 12 is spaced apart from the transfer belt 5, and when the multi-color toner image is completely transferred to the transfer belt 5, the transfer roller 12 contacts the transfer belt 5 with a predetermined pressure to transfer the multi-color toner image to the sheet of paper S.

Reference numeral 6 denotes a first cleaning device to remove waste toner remaining on the outer circumferential surface of the photosensitive drum 1 after the toner image is transferred to the transfer belt 5. The waste toner collected by the first cleaning device 6 is stored in a waste toner storage container (not shown).

Reference numeral 9 denotes a second cleaning device to remove waste toner remaining on the transfer belt 5 after the toner image is transferred to the sheet (S). The waste toner collected by the second cleaning device 9 is stored in a waste toner storage container (not shown).

Reference numeral 10 denotes a pre-transfer eraser. The pre-transfer eraser 10 removes charges from a non-image region of the photosensitive drum 1 before the toner image formed on the photosensitive drum 1 is transferred to the transfer belt 5, thereby improving transfer efficiency from the photosensitive drum 1 to the transfer belt 5.

Reference numeral 7 denotes an erasing lamp. The erasing lamp 7 is an eraser to erase charges remaining on the outer circumferential surface of the photosensitive drum 1 prior to charging. The erasing lamp 7 irradiates a predetermined amount of light onto the outer circumferential surface of the photosensitive drum 1 and erases the charges remaining on the photosensitive drum 1.

Reference numeral 8 denotes a power supply. The power supply 8 supplies a developing bias to develop a toner from the developing device 4 to the photosensitive drum 1, a development preventing bias to prevent toner from adhering to the photosensitive drum 1 from the developing device 4, a first transfer bias to transfer a toner image from the photosensitive drum 1 to the transfer belt 5, a second transfer bias to transfer the toner image from the transfer belt 5 to the sheet S, and a charge bias applied to the charge roller 2 to charge the photosensitive drum 1.

Reference numeral 11 is a fusing device to fix the toner image transferred to the sheet S on the sheet S. A fusing device 11 according to this embodiment is configured such that a pair of rollers 23 and 24 rotate in engagement with each other with a predetermined pressure. At least one of the pair of rollers 23 and 24 has a heating unit (not shown) to heat the toner image. In the illustrative embodiment, the heating unit is provided at each of the two rollers 23 and 24. When the sheet S to which the toner image is transferred passes through the fusing device 11, the toner image is fixed on the sheet S by heat and pressure, thereby completing image printing.

Reference numeral 13*a* denotes a feed cassette, for example, sheet supplying unit. The sheet supplying unit may further include a second feed cassette 13*b* and/or a multi-purpose feeder (MPF) 13*c*. The MPF 13*c* is typically used to transport non-regular sheets or overhead projector (OHP) sheets.

Reference numeral 16 denotes a feed roller to transport the sheet S fed from the feed cassette 13*a*, the second feed cassette 13*b* or the MPF 13*c* by a pickup roller 15*a*, 15*b* and 15*c*, respectively.

Reference numeral 17 denotes an ejection roller to eject the sheet S after printing. A sheet transport unit 20 includes a feed path 21 to guide the sheet S between the feed roller 16 and the fusing device 11, and a duplex path 22 to provide printing.

The sheet S, having an image printed on one side thereof and being fed past the fusing device 11, is ejected through a path 19 by the ejection roller 17 (17*a* and 17*b*). For duplex printing, the ejection roller 17 rotates in a reverse direction and the sheet S is transported from the path 19 to a duplex path 22. Then, the sheet S is reversed so as to print an image on the other side thereof. The reversed sheet S is transported again via the feed path 21 by the feed roller 16 and printing is performed on the other side of the sheet S.

An image forming process using the electrophotographic printer having the above-described construction will now be described.

Multi-color image information includes pieces of information on cyan (C), magenta (M), yellow (Y) and black (K). In an aspect of this embodiment, cyan (C), magenta (M), yellow (Y) and black (K) toner images overlap on the transfer belt 5 in that order, and then are transferred to the sheet S to be fixed thereon, thereby forming a multi-color image. It is to be noted that toner images may alternatively be overlapped in other orders which perform the intended aspects and/or features disclosed herein.

The outer circumferential surface of the photosensitive drum 1 is uniformly charged by the charge roller 2. If a light signal corresponding to cyan (C) image information is irradiated onto the rotating photosensitive drum 1 by the exposing unit 3, resistance of a portion onto which the light signal is irradiated is reduced and charges on the outer circumferential surface of the photosensitive drum 1 escape. Thus, a potential difference is generated between the light irradiated portion and a non-irradiated portion, thereby forming an electrostatic latent image on the outer circumferential surface of the photosensitive drum 1.

When the photosensitive drum 1 rotates to make the electrostatic latent image approach the cyan development unit 4C, rotation of a developing roller 25 of the cyan development unit 4C is commenced. Then, a development bias is applied from a power supply 8 to the developing roller 25 of the cyan development unit 4C. Meanwhile, a development preventing bias is applied to developing rollers 25 of the other development units 4M, 4Y and 4K. Then, only the cyan toner sticks to the electrostatic latent image formed on the outer circumferential surface of the photosensitive drum 1 across a developing gap Dg, thereby forming a cyan toner image.

When the photosensitive drum 1 rotates to make the cyan toner image approach the transfer belt 5, the cyan toner image is transferred to the transfer belt 5 by a first transfer bias and/or a contact pressure between the photosensitive drum 1 and the transfer belt 5.

After the cyan toner image is completely transferred to the transfer belt 5, magenta (M), yellow (Y) and black (K) toner images overlap on the transfer belt 5 through the above-described process.

During the above-described process, the transfer roller 12 is spaced apart from the transfer belt 5. If the four color toner images are all transferred to and overlap on the transfer belt 5 and a multi-color toner image is formed on the transfer belt 5, the transfer roller 12 contacts the transfer belt 5 to transfer the multi-color toner image on the sheet S.

The sheet S is supplied from a feed cassette 13*a*, a second feed cassette 13*b* or an MPF 13*c* so that a leading edge of the sheet S reaches a contact point of the transfer belt 5 and the transfer roller 12 when a leading edge of the multi-color toner image formed on the transfer belt 5 reaches the contact point. If the sheet S passes between the transfer belt 5 and the transfer roller 12, the multi-color toner image is transferred to the sheet S by a second transfer bias and fixed on the sheet S by the fusing device 11 by heat and pressure, and the sheet S having the fixed multi-color toner image can then be ejected through the path 19, thereby completing formation of a color image.

For subsequent printing operations, first and second cleaning devices 6 and 9 can remove waste toner remaining on the photosensitive drum 1 and the transfer belt 5, respectively, and an erasing lamp 7 can irradiate light onto the photosensitive drum 1 to remove residual charges on the photosensitive drum 1.

Figure 2:
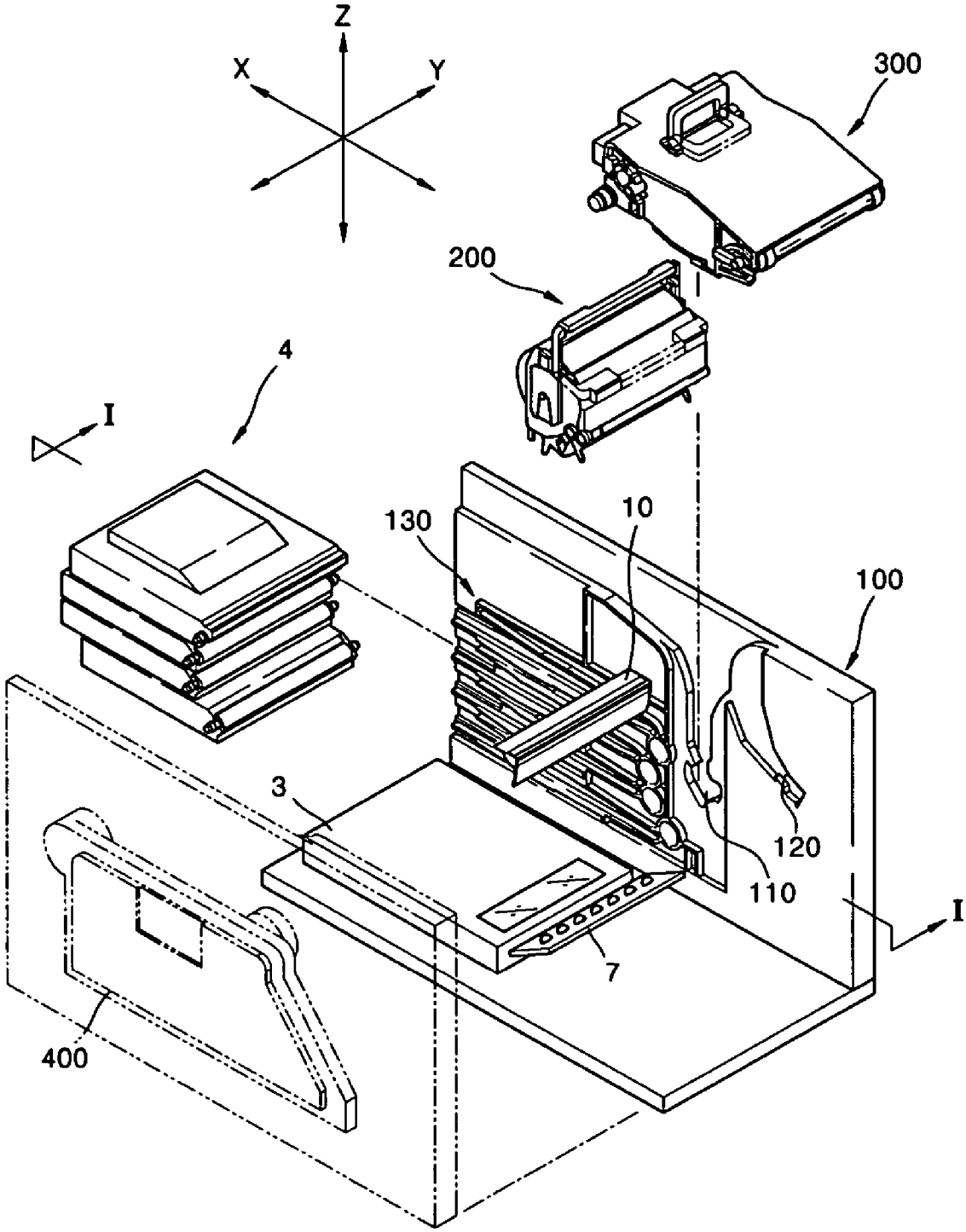
FIG. 2 is an exploded perspective view of the electrophotographic printer shown in FIG. 1.
Figure 3:
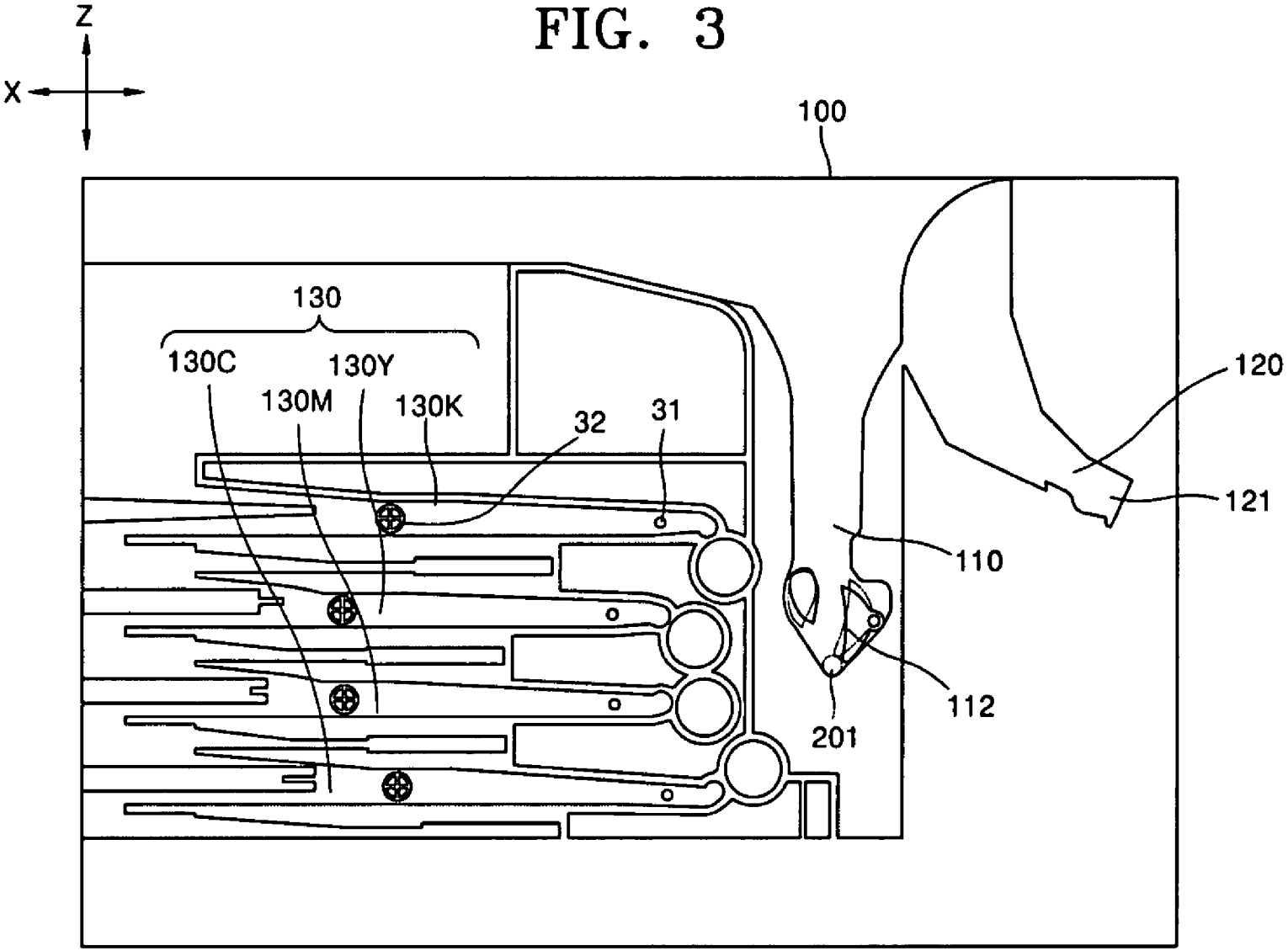
FIG. 3 is a cross-sectional view of the electrophotographic printer shown in FIG. 2, taken along the line I–I'.

FIG. 2 is an exploded perspective view of the electrophotographic printer shown in FIG. 1, and FIG. 3 is a cross-sectional view of the electrophotographic printer of FIG. 2, taken along the line I–I' of FIG. 2.

Referring to FIG. 2, on a main frame 100 are installed a photosensitive drum unit 200 having the photosensitive drum 1, an intermediate transfer unit 300 having the transfer belt 5, and four development units 4C, 4M, 4Y and 4K each having the developing roller 25.

The photosensitive drum unit 200 can be mounted or dismounted in a vertical direction Z. The intermediate transfer unit 300 can be disposed above the photosensitive drum unit 200 and can also be mounted or dismounted in the vertical direction Z. The development units 4C, 4M, 4Y and 4K can be slidably installed so as to be mounted or dismounted in a horizontal direction X from a lateral side of the photosensitive drum 1. In the illustrative embodiment, the development units 4C, 4M, 4Y and 4K are arranged such that the cyan development unit 4C, the magenta development unit 4M, the yellow development unit 4Y and the black development unit 4K are sequentially disposed upward in that order from the bottom. However, other sequential orders of the development units 4C, 4M, 4Y and 4K may be provided alternatively which perform the intended aspects and/or features disclosed herein. The pre-transfer eraser 10 can be disposed above the uppermost development unit 4K. The exposing unit 3 and the erasing lamp 7 can be disposed under the photosensitive drum unit 200. Reference numeral 400 denotes a waste toner storage container to store waste toner generated during printing. The waste toner storage container 400 can be installed so as to be mounted on or dismounted from the main frame 100 in a lengthwise direction Y of the photosensitive drum 1. Although not shown, the sheet transport unit 20 can be rotatably installed at the opposite side of the electrophotographic printer with respect to the development units 4C, 4M, 4Y and 4K in view of the photosensitive drum unit 200.

Referring to FIG. 3, the main frame 100 includes a first rail 110, a second rail 120 and third rails 130. The first rail 110 may be formed in the vertical direction Z as illustrated in FIG. 3 so that the photosensitive drum unit 200 can be mounted thereon in a vertical direction. The second rail 120 can slope downward so that the intermediate transfer unit 300 can be mounted thereon. The third rails 130 (130C, 130M, 130Y, 130K) can be formed in the horizontal direction X so that the development units 4C, 4M, 4Y and 4K are slidably mounted thereon. Although not shown, the first through third rails 110, 120 and 130 can be provided in pairs on respective opposite sides of the main frame 100, the pairs being opposite to each other. Reference numeral 112 denotes a fixing unit to fix the photosensitive drum unit 200 on the main frame 100 such that it rotates to reach a position indicated by a dotted line when the photosensitive drum unit 200 is completely mounted thereon.

Figure 4:
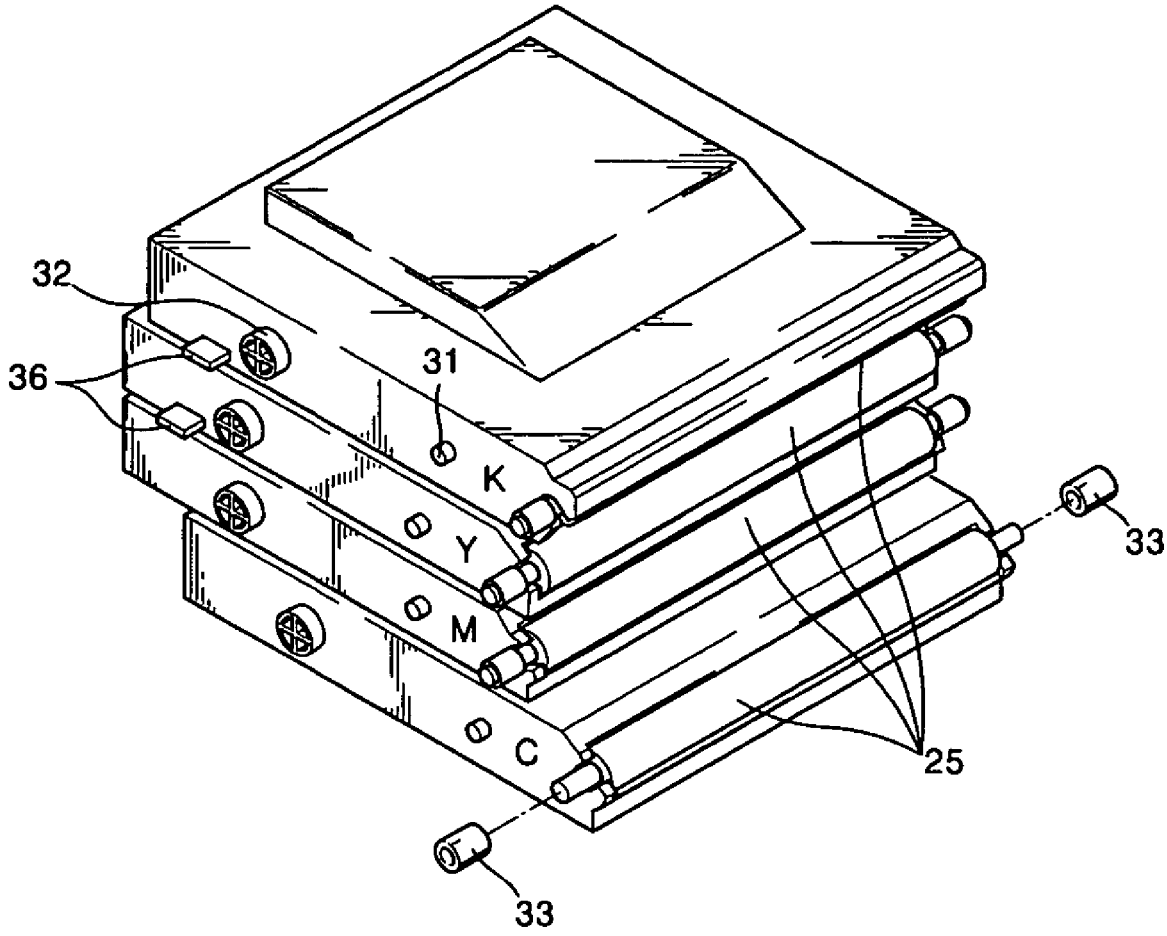
FIG. 4 is a perspective view of a developing device shown in FIG. 2.

FIG. 4 is a perspective view of a developing device shown in FIG. 2.

Referring to FIG. 4, the developing device includes four development units 4C, 4M, 4Y and 4K. Cyan (C), magenta (M), yellow (Y) and black (K) toners may be contained in the development units 4C, 4M, 4Y and 4K, respectively. Each of the development units 4C, 4M, 4Y and 4K can have a developing roller 25 to supply the corresponding toner contained therein to the photosensitive drum 1.

A first supporting unit 31 and a second supporting unit 32, inserted into the third rail 130, are provided at both sides of each of the development units 4C, 4M, 4Y and 4K. In the embodiment of FIG. 4, the first supporting unit 31 and the second supporting unit 32 may be bosses projecting from lateral surfaces of each of the development units 4C, 4M, 4Y and 4K so as to be inserted into the third rail 130. As shown in FIG. 3, the third supporting unit 31 and the fourth supporting unit 32 are inserted into the third rail 130 so that the development units 4C, 4M, 4Y and 4K are guided by the third rail 130 and slide in the horizontal direction X to then be mounted on the main frame 100.

Position determining units are provided in the respective development units 4C, 4M, 4Y and 4K to maintain a developing gap Dg between the developing roller 25 and the photosensitive drum 1 when the development units 4C, 4M, 4Y and 4K are mounted on the frame 100. In the illustrative embodiment of FIG. 4, a bushing 33 can be used as the position determining unit and can be installed at either side of the developing roller 25. The bushing 33 can have a greater radius than the developing roller 25 by a dimension corresponding to the developing gap Dg. Thus, the respective development units 4C, 4M, 4Y and 4K slide along the third rail 130 and stop when the bushing 33 contacts the outer circumferential surface of the photosensitive drum 1 and the developing roller 25 is spaced apart from the photosensitive drum 1 by the developing gap Dg.

Referring to FIGS. 2 through 4, the photosensitive drum unit 200 and the intermediate transfer unit 300 can be mounted on and dismount from the main frame 100 in the vertical direction Z, and the development units 4C, 4M, 4Y and 4K can be mounted on or dismounted from the main frame 100 in the horizontal direction X. As described above, the development units 4C, 4M, 4Y and 4K can be arranged such that a developing gap Dg is maintained between the photosensitive drum 1 and the developing roller 25. Thus, as shown in FIG. 1, the development units 4C, 4M, 4Y and 4K can be arranged in a manner that they surround one side of the photosensitive drum 1. In an aspect of this embodiment, development units 4C, 4M, 4Y and 4K are symmetrical with one another in a vertical direction. Due to such characteristic arrangement of the photosensitive drum 1, the photosensitive drum unit 200, and the intermediate transfer belt 300, it is an aspect of this embodiment that the development units 4C, 4M, 4Y and 4K are mounted in that order. The photosensitive drum unit 200 should be removed after at least the development units 4Y and 4K are retracted to a position at which they do not interfere with the photosensitive drum 1 during an upward extraction of the photosensitive drum unit 200.

Figure 5:
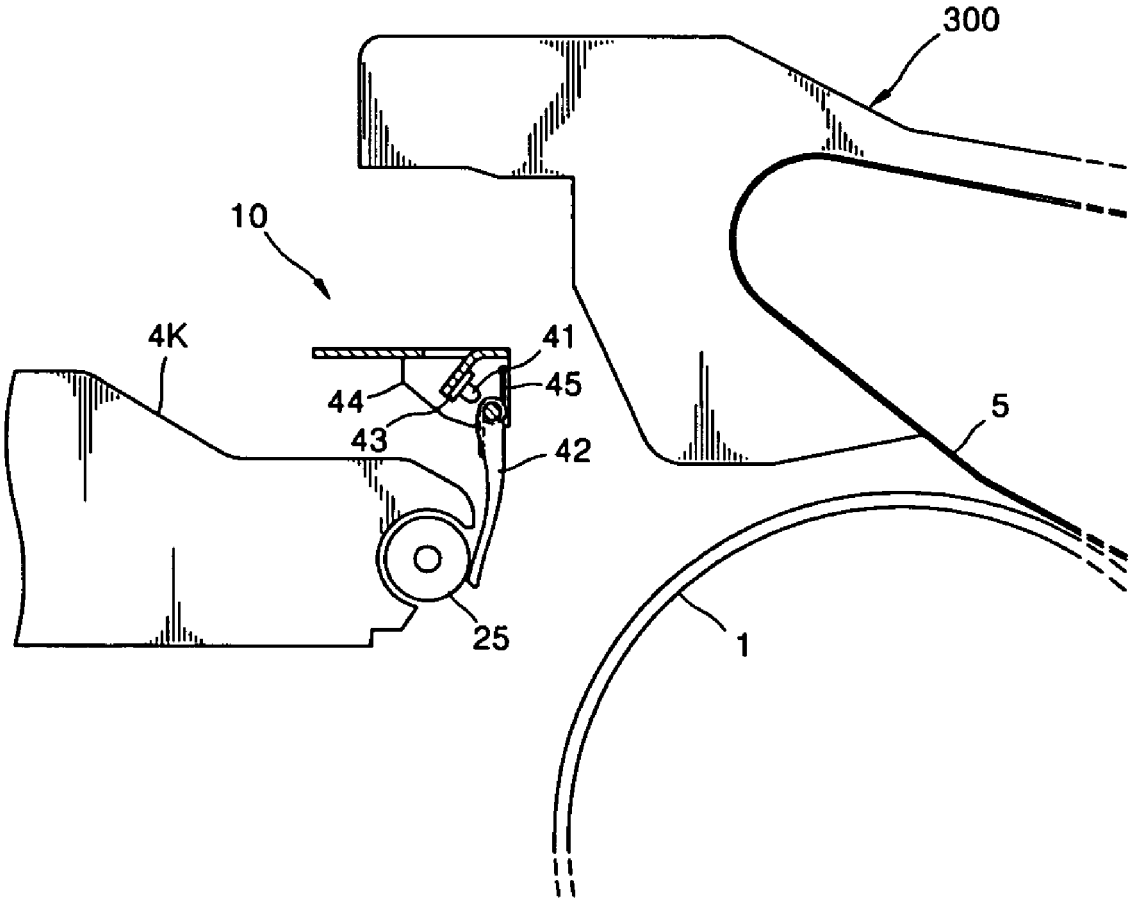
FIGS. 5 and 6 are side views illustrating a pre-transfer erasing unit shown in FIG. 2.
Figure 6:
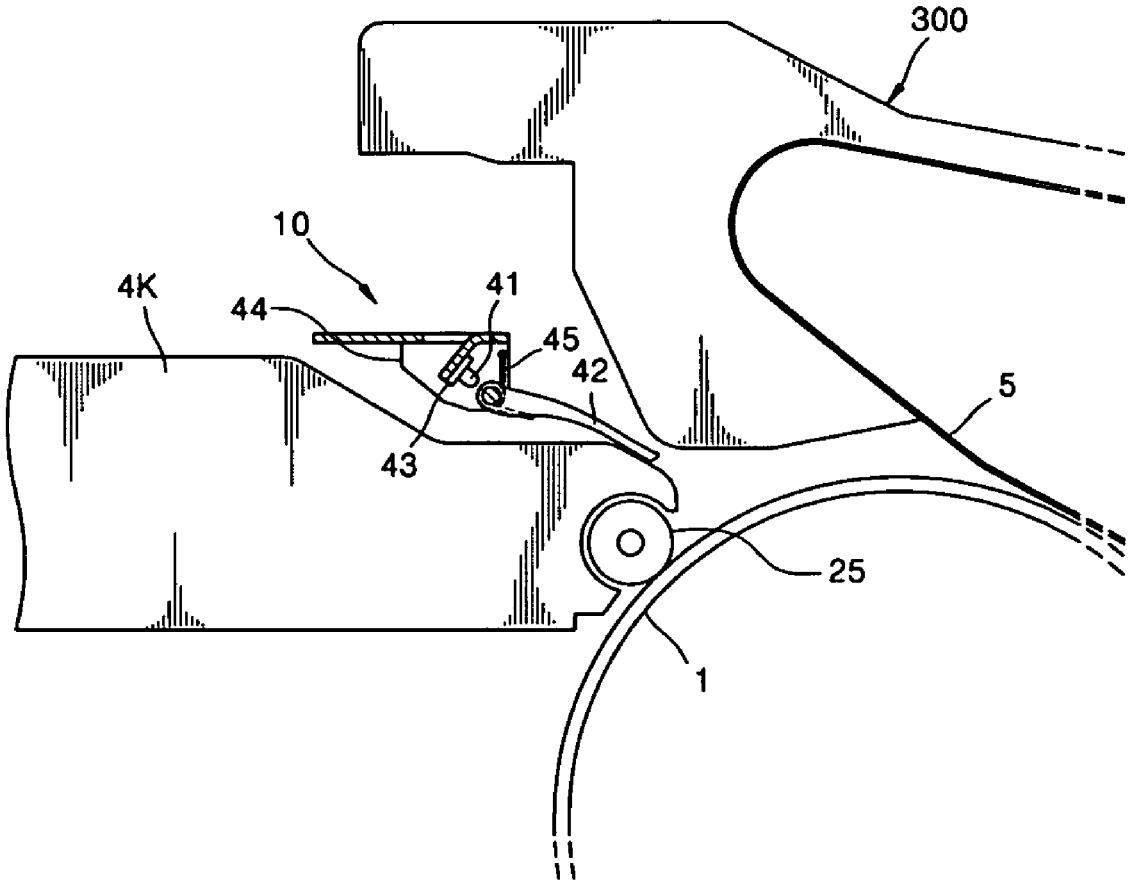

FIGS. 5 and 6 are detailed side views of the pre-transfer eraser 10 shown in FIG. 2.

Referring back to FIG. 2, the pre-transfer eraser 10 is positioned above the uppermost development unit 4K and is fixedly installed on the main frame 100. In order to avoid interference occurring when the photosensitive drum 1 is being mounted or dismounted in a vertical direction, the pre-transfer eraser 10 would normally have to be spaced apart from the outer circumference of the photosensitive drum 1 in a horizontal direction. In this usual case, however, a distance between the pre-transfer eraser 10 and the photosensitive drum 1 is too long to achieve effective erasure. Therefore, the pre-transfer eraser 10 according to the illustrative embodiment, as shown in FIGS. 5 and 6, includes a pre-transfer erasing lamp 41 and a pre-transfer erasing lens 42 to induce light generated from the pre-transfer erasing lamp 41 to a surface of the photosensitive drum 1. The pre-transfer erasing lens 42 is movably installed such that it moves to an erasure position at which the pre-transfer erasing lens 42 is close to the photosensitive drum 1 so as to guide the light irradiated from the pre-transfer erasing lamp 41 to provide erasure thereof, and to a retracted position spaced apart from the photosensitive drum 1 so as to mount or dismount the photosensitive drum unit 200. The pre-transfer erasing lamp 41 can be installed in plural numbers on the PCB 43 extending in a lengthwise direction of the photosensitive drum 1. Although not shown, the pre-transfer erasing lamp 41 may be installed at one end or both ends of the pre-transfer erasing lens 42 lengthwise.

Referring to FIG. 5, a holder 44 can be installed on a main frame 100, and the PCB 43 having a pre-transfer erasing lamp 41 can be fixed to the holder 41. The pre-transfer erasing lens 42 can be rotatably installed on the holder 41. Reference numeral 45 denotes an elastic member to apply an elastic force to the pre-transfer erasing lens 42 so that the pre-transfer erasing lens 42 rotates in a direction in which it retracts from the photosensitive drum 1.

A pre-transfer erasing procedure can be performed between the development and transfer operations. The pre-transfer eraser 10 can be positioned between the developing device 4 and the transfer belt 5. The pre-transfer erasing lens 42 rotates to an erasure position and a retracted position according to attachment or detachment of the developing device 4. As shown in the electrophotographic printer of the illustrative embodiment, if a plurality of development units 4C, 4M, 4Y and 4K are provided, the pre-transfer erasing lens 42 can rotate according to attachment and detachment of the development unit 4K closest to the transfer belt 5. It is to be noted that any developing unit can be used that provides the intended aspects and/or features disclosed herein.

Referring to FIG. 6, when the development unit 4K retracts, the pre-transfer erasing lens 42 can be rotated to the retracted position by an elastic force of the elastic member 45. In this state, even if the photosensitive drum unit 200 is removed, the pre-transfer erasing lens 42 and the photosensitive drum 1 do not interfere with each other. If the photosensitive drum unit 200 is mounted and the development unit 4K is pushed in a horizontal direction towards the photoconductive drum unit 200, an upper end of the development unit 4K interferes with the pre-transfer erasing lens 42 such that the pre-transfer erasing lens 42 can rotate to an erasure position. If the development unit 4K is completely mounted, as shown in FIG. 10, the pre-transfer erasing lens 42 can reach the erasure position facing the photosensitive drum 1. If the development unit 4K is retracted from the mounting position, the pre-transfer erasing lens 42 can be rotated to a retracted position by an elastic force of the elastic member 45.

Although this illustrative embodiment has shown that the photosensitive drum 1 can be mounted or dismounted in a vertical direction, the pre-transfer eraser 10 according to this embodiment can be applied to the case in which the photosensitive drum 1 is slidably mounted or dismounted in the lengthwise direction Y, which is not shown in the drawings. In order to achieve erasure, the pre-transfer erasing lens 42 should be adjacent to an outer circumferential surface of the photosensitive drum 1. Thus, in the case where the photosensitive drum 1 is mounted or dismounted in the lengthwise direction Y, one way to prevent the photosensitive drum 1 from being damaged by the pre-transfer erasing lens 42 is to separate the pre-transfer erasing lens 42 from the photosensitive drum 1. Also, although the illustrative embodiment has shown that the development unit 4K can be mounted or dismounted in a horizontal direction, the pre-transfer eraser 10 according to this embodiment can also be configured such that even when the development unit 4K slides in the lengthwise direction Y of the photosensitive drum 1, the pre-transfer erasing lens 42 can move to an erasure position and a retracted position by a contact between the development unit 4K and the pre-transfer erasing lens 42 and an elastic force of the elastic member 45.

In the illustrated embodiment, the electrophotographic printer having four development units 4C, 4M, 4Y and 4K for color image printing has been shown. However, the illustrated embodiment has been presented for purposes of providing the best illustration of the invention and its practical application to thereby enable one of ordinary skill in the art to utilize the pre-transfer eraser according to the present invention in an electrophotographic printer having a single development unit to provide monochrome image printing (although not shown).

As described above, in the electrophotographic printer according to the present invention, since the pre-transfer eraser moves to an erasure position and a retreat position in association with the mounting or dismounting of the developing device, the photosensitive drum can be prevented from being damaged by the pre-transfer eraser when the photosensitive drum is mounted or dismounted.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An electrophotographic printer comprising:

a photosensitive drum on which an electrostatic latent image is formed;

at least one development unit having a developing roller to form a toner image by supplying toner to the electrostatic latent image; and a pre-transfer erasing unit to remove charges from a non-image region of the photosensitive drum by irradiating light onto the photosensitive drum after the toner image is developed, the pre-transfer erasing unit comprising:

a pre-transfer erasing lamp to irradiate light, and a pre-transfer erasing lens to induce the light generated from the pre-transfer erasing lamp to the photosensitive drum, movably installed such that it moves to an erasure position at which the pre-transfer erasing lens is close to the photosensitive drum to provide erasure, and to a retracted position spaced apart from the photosensitive drum so as not to interfere therewith when the photosensitive drum unit is being mounted or dismounted.

2. The electrophotographic printer of claim 1, wherein the pre-transfer erasing unit further comprises an elastic member to provide elasticity in a direction in which the pre-transfer erasing lens moves to the retracted position, the pre-transfer erasing lens contacting the development unit when the developing unit is mounted to then move to the erasure position, and the pre-transfer erasing lens returning to the retracted position by the elasticity of the elastic member when the development unit is extracted.

3. The electrophotographic printer of claim 2, wherein the photosensitive drum unit is mounted or dismounted in a vertical direction, and the development unit is mounted or dismounted while sliding in a horizontal direction.

4. The electrophotographic printer of claim 1, further comprising a plurality of development units containing different color toners, wherein the pre-transfer erasing unit further comprises an elastic member providing elasticity in a direction in which the pre-transfer erasing lens moves to the retreat position, the pre-transfer erasing lens contacting at least one of the plurality of development units to then be moved to the erasure position, and the pre-transfer erasing lens returning to the retracted position by the elasticity of the elastic member when the development unit is extracted.

5. The electrophotographic printer of claim 4, further comprising a transfer belt positioned above the photosensitive drum and to which the toner image is transferred, the pre-transfer erasing unit contacting one among the plurality of development units that is closest to the transfer belt to move to the erasure position.

6. The electrophotographic printer of claim 5, wherein the photosensitive drum is mounted on or dismounted in a vertical direction.

7. The electrophotographic printer of claim 6, wherein the plurality of development units are mounted or dismounted while sliding in a horizontal direction.

8. The electrophotographic printer of claim 2, wherein the pre-transfer erasing unit further comprises a holder installed in the printer having a printed circuit board fixed thereon to hold the pre-transfer erasing lamp.

9. The electrophotographic printer of claim 8, wherein the pre-transfer erasing lens is rotatably installed on the holder.

10. The electrophotographic printer of claim 9, wherein the development unit causes the pre-transfer erasing lens to rotate toward the photoconductive drum when the development unit is being mounted in the printer and causes the pre-transfer erasing lens to retract from the photoconductive drum by elasticity of the elastic member when the development unit is being dismounted from the printer.

11. The electrophotographic printer of claim 10, wherein the development unit is mounted within the printer in a horizontal direction with respect to the photoconductive drum.

12. The electrophotographic printer of claim 10, wherein the development unit is mounted within the printer in a lengthwise direction with respect to an axial rotation direction of the photoconductive drum.

13. An electrophotographic printer comprising:

a photosensitive drum on which an electrostatic latent image is formed;

at least one development unit to form a toner image on the photoconductive drum; and a pre-transfer eraser member to remove charges from a non-image region of the photosensitive drum by irradiating light onto the photosensitive drum after the toner image is developed, the pre-transfer eraser member being movable to a first position close to the photosensitive drum within the electrophotographic printer to direct the irradiated light to the photosensitive drum to perform erasing, and being movable to a second position spaced apart from the photosensitive drum within the electrophotographic printer such that the photosensitive drum unit is mountable and dismountable away from the pre-transfer eraser.

14. The electrophotographic printer of claim 13, wherein the pre-transfer eraser member moves to the first position in response to mounting of the at least one development unit within the printer and moves to the second position in response to dismounting of the development unit from the printer.

15. An electrophotographic printer comprising:

a photosensitive drum on which an electrostatic image is formed;

at least one developing unit to form a toner image on the photoconductive drum; and a pre-transfer erasing unit movable by the at least one development unit between a first position to remove charges from a non-image region of the photosensitive drum and a second position to prevent the pre-transfer erasing unit from interfering with mounting or dismounting of the photosensitive drum.

16. The electrophotographic printer of claim 15, further comprising:

a frame to house the photosensitive drum, the at least one development unit, and the pre-transfer erasing unit, wherein the pre-transfer erasing unit is engageable by the at least one development unit such that the pre-transfer erasing unit is disposed in the first position when the at least one development unit is inserted in the frame and is disposed in the second position when the at least one development unit is removed from the frame.

17. The electrophotographic printer of claim 15, wherein the pre-transfer erasing unit comprises:

a lamp unit to emit light;

a lens unit to guide the emitted light and being engageable by the at least development unit; and an elastic member to bias the pre-transfer erasing unit toward the second position.

* * * * *